US008864369B2

(12) United States Patent
Netuschill

(10) Patent No.: US 8,864,369 B2
(45) Date of Patent: Oct. 21, 2014

(54) MEMBER COMPRISING A CERAMIC ELEMENT

(71) Applicant: Comadur S.A., Le Locle (CH)

(72) Inventor: Alexandre Netuschill, Le Locle (CH)

(73) Assignee: Comadur S.A., Le Locle (CH)

( * ) Notice: Subject to any disclaimer, the term of this patent is extended or adjusted under 35 U.S.C. 154(b) by 66 days.

(21) Appl. No.: 13/735,131

(22) Filed: Jan. 7, 2013

(65) Prior Publication Data

US 2013/0182544 A1 Jul. 18, 2013

(30) Foreign Application Priority Data

Jan. 13, 2012 (EP) ..... 12151147

(51) Int. Cl.

| | |
|---|---|
| ***G04B 37/00*** | (2006.01) |
| ***G04B 37/08*** | (2006.01) |
| ***G04B 19/28*** | (2006.01) |
| ***G04B 39/02*** | (2006.01) |

(52) U.S. Cl.

CPC ..... *G04B 37/00* (2013.01); *G04B 37/08* (2013.01); *G04B 19/283* (2013.01); *G04B 39/02* (2013.01)

USPC ..... 368/295; 368/280; 368/294

(58) Field of Classification Search

USPC ..... 368/276, 280, 281, 294–296

See application file for complete search history.

(56) References Cited

U.S. PATENT DOCUMENTS

| | | | | |
|---|---|---|---|---|
| 3,386,239 | A * | 6/1968 | Shiffman | 368/296 |
| 4,322,834 | A * | 3/1982 | Schaeren et al. | 368/296 |
| 6,616,329 | B1 * | 9/2003 | Sasaki et al. | 368/294 |
| 2003/0043698 | A1 * | 3/2003 | Guerry et al. | 368/282 |

FOREIGN PATENT DOCUMENTS

| | | | |
|---|---|---|---|
| CH | 640 995 | A3 | 2/1984 |
| EP | 1 041 460 | A1 | 10/2000 |
| IT | 1 169 883 | B | 6/1987 |
| JP | 63-200089 | | 8/1988 |
| JP | 63-249085 | | 10/1988 |

OTHER PUBLICATIONS

European Search Report issued Sep. 19, 2012, in European Patent Application No. 12151147.1, filed Jan. 13, 2012 (with English Translation).

* cited by examiner

*Primary Examiner* — Vit W Miska

(74) *Attorney, Agent, or Firm* — Oblon, Spivak, McClelland, Maier & Neustadt, L.L.P.

(57) ABSTRACT

The invention relates to a member (1) comprising a ceramic element (3) intended to be fitted against a body (5). According to the invention, the member includes a cooperation device (7) comprising a deformable insert (2) for locking the fit between the ceramic element (3) and the body (5), and a means of adherence (13) between the insert (2) and the ceramic element (3), in order to decrease the relative movement between said ceramic element (3) and said insert (2). The invention concerns the field of external elements for timepieces.

8 Claims, 2 Drawing Sheets

MEMBER COMPRISING A CERAMIC ELEMENT

This application claims priority from European Patent Application No. 12151147.1 filed Jan. 13, 2012, the entire disclosure of which is incorporated herein by reference.

FIELD OF THE INVENTION

The invention relates to a member comprising a ceramic element, and more specifically, a member of this type intended to form an external timepiece element.

BACKGROUND OF THE INVENTION

Ceramic elements are generally used for their mechanical and chemical resistance. However, when these ceramic elements have to be fixed to another part, it becomes difficult to ensure the fixing thereof.

SUMMARY OF THE INVENTION

It is an object of the present invention to overcome all or part of the aforementioned drawbacks, by providing a member having a ceramic element with improved fit thereof.

The invention therefore relates to a member comprising a ceramic element intended to be fitted against a body, a cooperation device comprising a deformable insert for locking the fit between the ceramic element and the body, characterized in that the cooperation device also includes a means of adherence between the insert and the ceramic element comprising recesses, formed on the ceramic element and intended to increase local roughness, in order to decrease the relative movement between said ceramic element and said insert.

In accordance with other advantageous features of the invention:

- the recesses form a first series of parallel, rectilinear grooves which intersects with a second series of parallel, rectilinear grooves;
- the first and second series of grooves are oblique to the height of said element;
- the grooves of the first series extend substantially perpendicularly to the grooves of the second series;
- the recesses comprise an arithmetic mean roughness of between 0.2 and 3 μm;
- the insert is made of polymer or metal;
- the body is made of metal.

Moreover, the invention relates to a timepiece, characterized in that at least one external element is formed by at least one member according to one of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
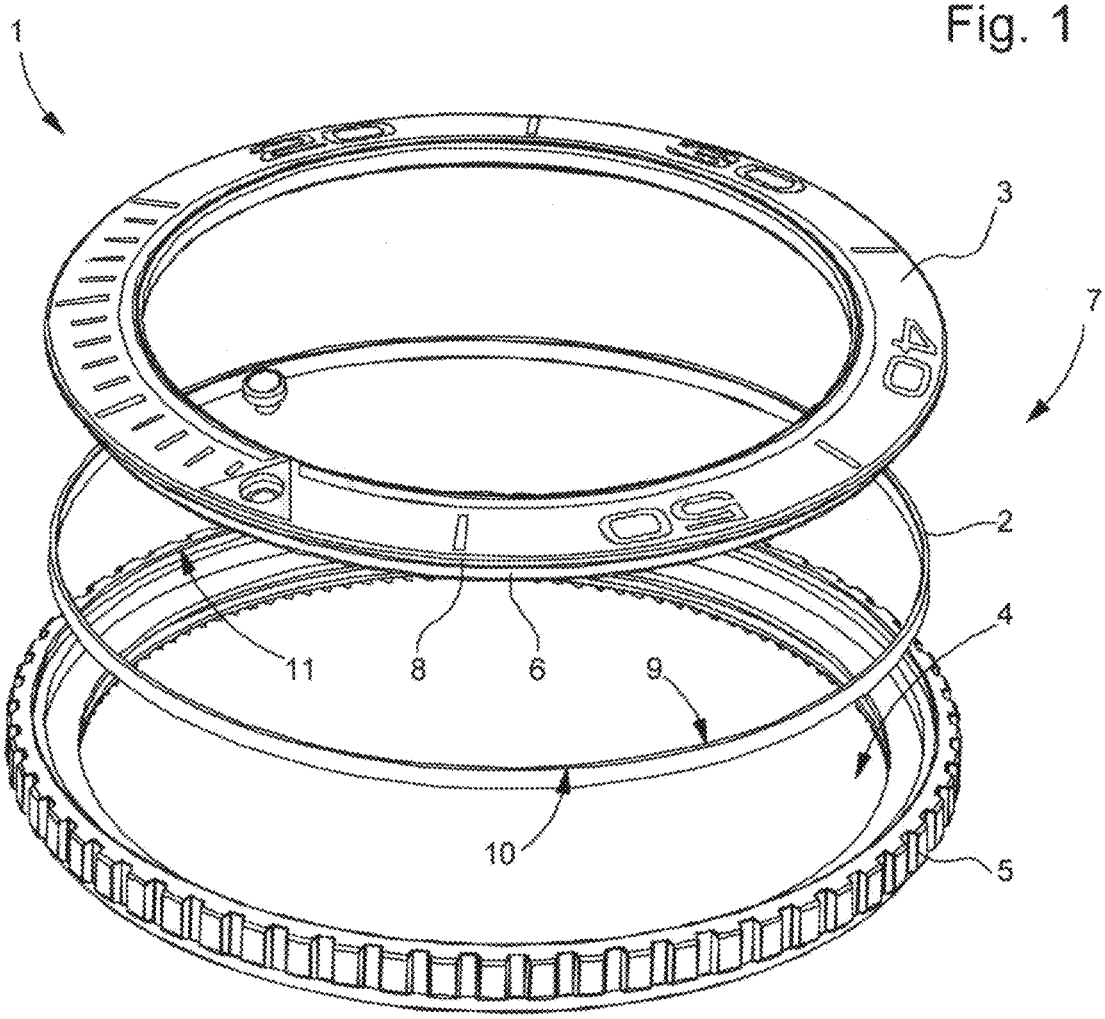
FIG. 1 is an exploded perspective view of a member according to the invention.

The invention relates to a member 1 including a ceramic element 3 intended to be fitted into the inner cavity 4 of a body 5. Preferably, the member according to the invention is intended to form an external element of a timepiece such as, or part of a bracelet or wristband, case or bezel. The member according to the invention therefore includes a ceramic element such as oxides like alumina or zirconia, or carbides, borides or nitrides formed of silicon and atoms such as tungsten, magnesium, platinum or titanium.

Naturally, although the invention was developed for the field of horology, it is not limited thereto. Other applications may also be envisaged such as jewellery or tableware.

In the above example, in a non-limiting manner, member 1 is a rotating bezel for a timepiece. Advantageously according to the invention, member 1 includes a cooperation device 7 comprising a deformable insert 2 for locking the press fit between the ceramic element 3 and body 5. Body 5 is preferably formed from a metal or metal alloy. However, other materials may be envisaged.

Preferably, insert 2 is made of polymer or metal and the shape of internal surface 9 thereof matches the external shape of the heel 6 of ceramic element 3. In FIG. 1, in a non-limiting manner, insert 2 is substantially annular in order to fit the external surface of heel 6 which is substantially circular.

Likewise, external surface 10 of insert 2 matches the shape of the internal surface of inner cavity 4 of body 5. In FIG. 1, in a non-limiting manner, insert 2 is substantially annular in order to fit the internal surface of inner cavity 4 of body 5 which is substantially circular.

Figure 2:
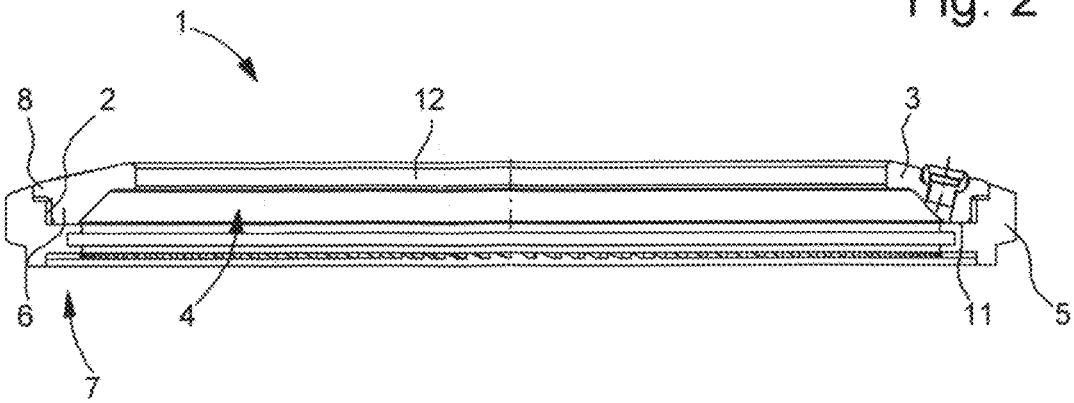
FIG. 2 is a cross-section of an assembled member according to the invention.

It is thus clear that ceramic element 3 is fitted onto the shoulder 11 of body 5 via the deformation of insert 2. FIG. 2 shows that, to improve the finish of the fit, ceramic element 3 may comprise a collar 8 intended to conceal shoulder 11 and insert 2.

Preferably according to the invention, cooperation device 7 also includes a means of adherence 13 between insert 2 and ceramic element 3 in order to decrease the relative movement between said insert 2 and element 3. According to the invention, means of adherence 13 includes recesses 14 formed in ceramic element 3 for increasing local roughness, i.e. at least on the external surface of heel 6. Recesses 14 may have an arithmetic mean roughness ($R_a$) of between 0.2 and 3 μm and preferably between 0.4 and 0.8 μm. Further, recesses 14 are preferably structured in a destructive manner, such as for example by means of infrared laser radiation.

Figure 3:
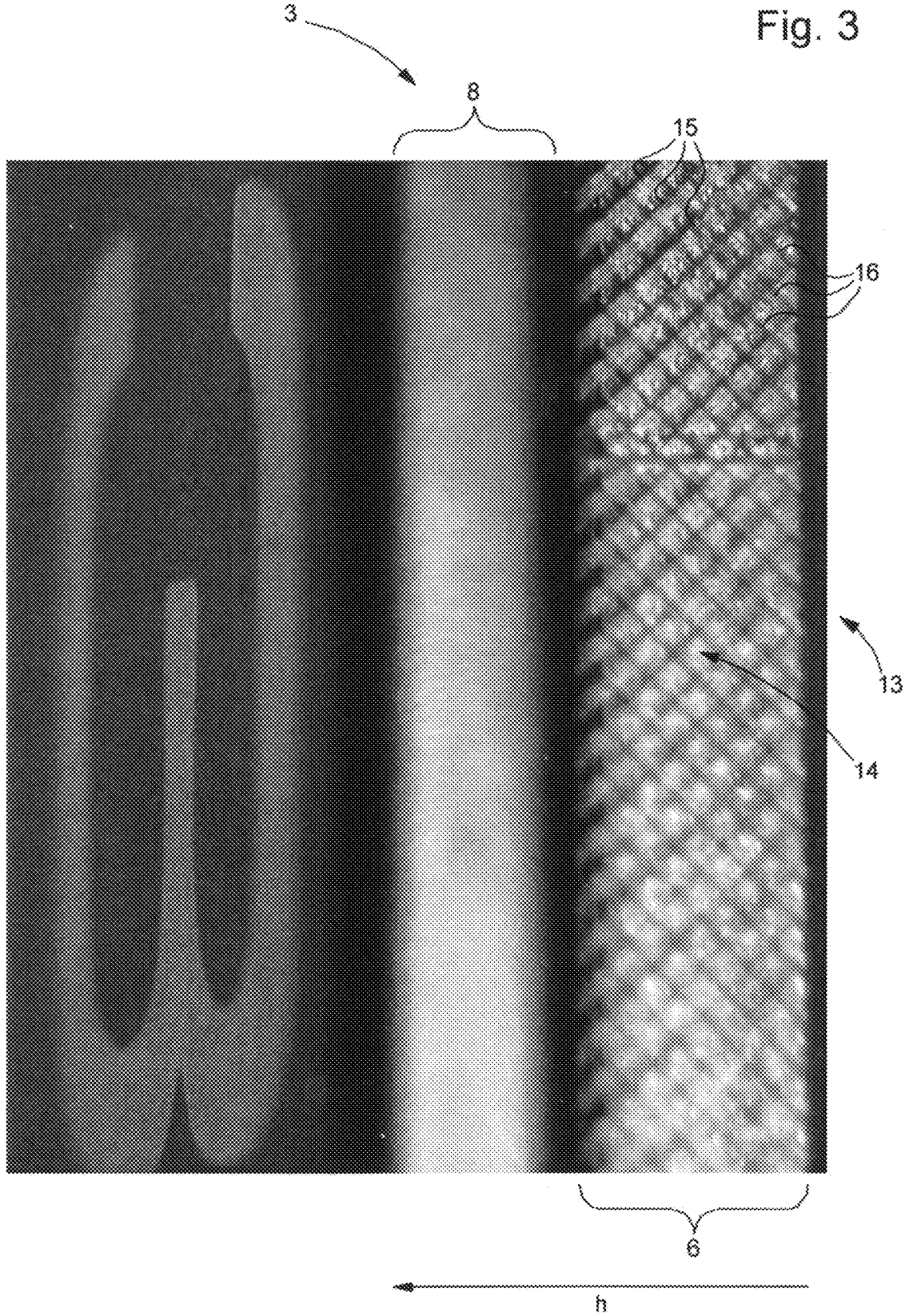
FIG. 3 is a photograph showing a ceramic element according to the invention.

Thus, as seen in the example of FIG. 3, recesses 14 may form a first series 15 of parallel, rectilinear grooves which intersects with a second series 16 of parallel, rectilinear grooves. It is clear that these recesses 14 form a sort of knurled area on insert 2 when ceramic element 3 is fitted onto body 5, which will prevent any relative movement between insert 2 and ceramic element 3.

This same example of FIG. 3 also shows that the first and second series 15, 16 of grooves are oblique to the height h of said element. Finally, it is seen that the grooves of the first series 15 extend substantially perpendicularly to the grooves of the second series 16 forming a knurled area reproducing an arrangement of squares and/or diamonds.

Of course, this invention is not limited to the illustrated example but is capable of various variants and alterations that will appear to those skilled in the art. In particular, the ceramic element, the body or the insert may have different dimensions and/or shapes for adaptation to other parts and/or applications without departing from the scope of the invention.

Further, without losing the advantages of the invention, the first and second series of grooves may also each be oblique and/or perpendicular and/or parallel to the height h of said element. Likewise, the grooves of the first series 15 may extend substantially non-perpendicularly to the grooves of the second series forming a different arrangement from FIG. 3.

Finally, it is also perfectly possible to envisage the internal surface of the ceramic element receiving in succession the insert and the body.

What is claimed is:

1. A member for a timepiece comprising a ceramic element intended to be fitted against a body, a cooperation device comprising a deformable insert for locking the fit between the ceramic element and the body, wherein the cooperation device also includes a means of adherence between the insert and the ceramic element comprising recesses, formed on the ceramic element and intended to increase local roughness, in order to decrease the relative movement between said ceramic element and said insert.

2. The member according to claim 1, wherein the recesses form a first series of parallel, rectilinear grooves which intersects with a second series of parallel, rectilinear grooves.

3. The member according to claim 2, wherein the first and second series of grooves are oblique to the height of said element.

4. The member according to claim 2, wherein the grooves of the first series extend substantially perpendicularly to the grooves of the second series.

5. The member according to claim 1, wherein the recesses have an arithmetic mean roughness comprised between 0.2 and 3 μm.

6. The member according to claim 1, wherein the insert is made of polymer or metal.

7. The member according to claim 1, wherein the body is made of metal.

8. A timepiece wherein at least one external element is formed by at least one member according to claim 1.

* * * * *